United States Patent [19]

Mullins

[11] Patent Number: 5,032,695

[45] Date of Patent: Jul. 16, 1991

[54] MEMBRANE SWITCH WITH MOVABLE AND FIXED FLAP CONTACTS MOUNTED ON A COMMON DIELECTRIC SUBSTRATE

[75] Inventor: Barry Mullins, Claremont, Calif.

[73] Assignee: Alps Electric (USA), Inc., San Jose, Calif.

[21] Appl. No.: 514,773

[22] Filed: Apr. 26, 1990

[51] Int. Cl.[5] ..... H01H 1/10; H01H 13/70

[52] U.S. Cl. ..... 200/512; 200/5 A; 200/292

[58] Field of Search ..... 200/5 A, 5 R, 86 R, 200/512-517, 292

[56] References Cited

U.S. PATENT DOCUMENTS

| | | | |
|---|---|---|---|
| 3,294,927 | 12/1966 | Hill | 200/5 R |
| 3,745,288 | 7/1973 | Reimer | 200/292 |
| 3,777,082 | 12/1973 | Hatley et al. | 200/5 A |
| 3,911,234 | 10/1975 | Kotaka | 361/398 X |
| 4,032,729 | 6/1977 | Koistinen | 200/5 A |
| 4,066,851 | 1/1978 | White et al. | 200/86 R X |
| 4,314,117 | 2/1982 | Ditzig | 200/5 A |
| 4,354,081 | 10/1982 | Serras-Paulet | 200/404 |
| 4,362,911 | 12/1982 | Sears et al. | 200/5 A |
| 4,400,595 | 8/1983 | Ahumada | 200/5 A |
| 4,503,294 | 3/1985 | Matsumaru | 200/5 A |
| 4,515,999 | 5/1985 | Harper | 200/5 A |
| 4,529,849 | 7/1985 | Kamei et al. | 200/5 A |

*Primary Examiner*—J. R. Scott

*Attorney, Agent, or Firm*—Guy W. Shoup; David E. Steuber

[57] ABSTRACT

A membrane key switch includes a single resiliently deformable dielectric membrane with flaps cut therein which is formed in a housing such that the end of each flap covers a portion of the membrane. Conductive traces of the membrane are positioned so that downward flexing of the flap, caused by actuation of the switch, establishes electrical contact between a contact region on the flap end and a contact region on an uncut portion of the membrane.

15 Claims, 6 Drawing Sheets

MEMBRANE SWITCH WITH MOVABLE AND FIXED FLAP CONTACTS MOUNTED ON A COMMON DIELECTRIC SUBSTRATE

FIELD OF THE INVENTION

This invention relates to a membrane key switch having a single flexible dielectric sheet on which conductive traces are formed.

BACKGROUND OF THE INVENTION

Although a variety of membrane key switches for use in keyboards or other data input devices are known, a number of problems relating to the manufacture and use of these switches is common. For instance, incorporating aftertravel into prior art membrane key switch designs has been both difficult and costly.

A sectional view of a typical prior art membrane key switch is shown in FIG. 1. Upper membrane 1 and lower membrane 2 with conductive traces formed thereon are separated by a solid dielectric spacer 3 having an aperture 4. The switch is actuated by depressing key head 5, which forces upper membrane 1 to flex downward through the aperture 4 of spacer 3 and contact stationary lower member 2. Thus, conductive traces on the upper and lower membrane contact each other and complete an electrical circuit. When pressure on the key head 5 is released, return spring 6 returns the key switch to its raised position. This membrane key switch has a serious.drawback in that the keyboard base 7 supports the lower membrane 2 and so the key stem 8 cannot move further downward once contact between the conductive traces on the upper and lower membranes is made unless inner spring 9 is present, as described below. The switch makepoint is at the end of switch travel and, consequently, no aftertravel following completion of an electrical circuit is possible.

By having makepoints at the end of switch travel, typical membrane key switches require complete depression of the key in order to make electrical contact. This requirement can cause data entry errors by operators, especially high speed typists who often do not completely depress the keys of a keyboard. In addition, the lack of aftertravel shocks the operator's finger by preventing follow through movement.

An inner membrane depression spring 9 attached to key stem 8 has been used for forcing upper membrane 1 downwards and allowing aftertravel of the key head 5 after the spring 9 forces upper membrane 1 to contact lower membrane 2. However, this design necessitates the use of two springs which adds expense to the manufacture of the switch and aggravates the disadvantages associated with springs, such as loss of rigidity and sensitivity to corrosion.

SUMMARY OF THE INVENTION

According to this invention a membrane key switch is provided which uses only one flexible dielectric sheet to create an entire keyboard switching matrix. The use of only one dielectric sheet eliminates the need for spacers and one of the two dielectric sheets generally used to create a switching matrix. Simplifying construction of the switch in this manner significantly reduces production and tooling costs. In addition, a membrane key switch according to this invention allows aftertravel by locating the switch makepoint at an intermediate point in switch travel.

To form a membrane key switch according to one embodiment of this invention, a three-sided flap is cut in a flexible dielectric sheet at a position corresponding to each desired key switch and electrical contact. Conductive material is placed along the bottom of the dielectric sheet, including the bottom edge of each flap, and along the top of the dielectric sheet to form the X and Y conductive traces of an XY switching matrix. The contacting regions of the X and Y conductive traces will face each other when the switch is assembled.

The contacting regions on the bottom side of the flaps are correctly positioned to face the contacting regions on the top of the dielectric sheet because the area of the dielectric sheet between the flaps is formed to fit a depression in the keyboard base. The area between the flaps covers a longer path than the flaps so that a portion of the flaps overlaps but is separated from a portion of the dielectric sheet. The flaps are angled upward by an upward sloping area of the keyboard base so that the contact region of the flaps does not unintentionally make an electrical connection with the contact region of the dielectric sheet.

Upon actuation of the membrane key switch the key stem moves downward, forcing the flap downward. After an electrical connection is made between the contact regions of the flap and the dielectric sheet, the key stem can continue to travel downward as the flap flexes, causing the contact regions to slide past each other. Importantly, this design allows aftertravel of the switch without the addition of an extra spring fitted to the key stem. In addition, the sliding action between the contact regions can help to keep them clean.

A membrane key switch according to a second embodiment of this invention uses an L-shaped flap and operates in substantially the same manner as described above. In the second embodiment, however, a leg of the L-shaped flap is deformed by the switch housing so that the contact region on the bottom side of the other leg can be positioned above but separated from the contact region on the top side of the membrane.

DETAILED DESCRIPTION OF THE INVENTION

Figure 1:
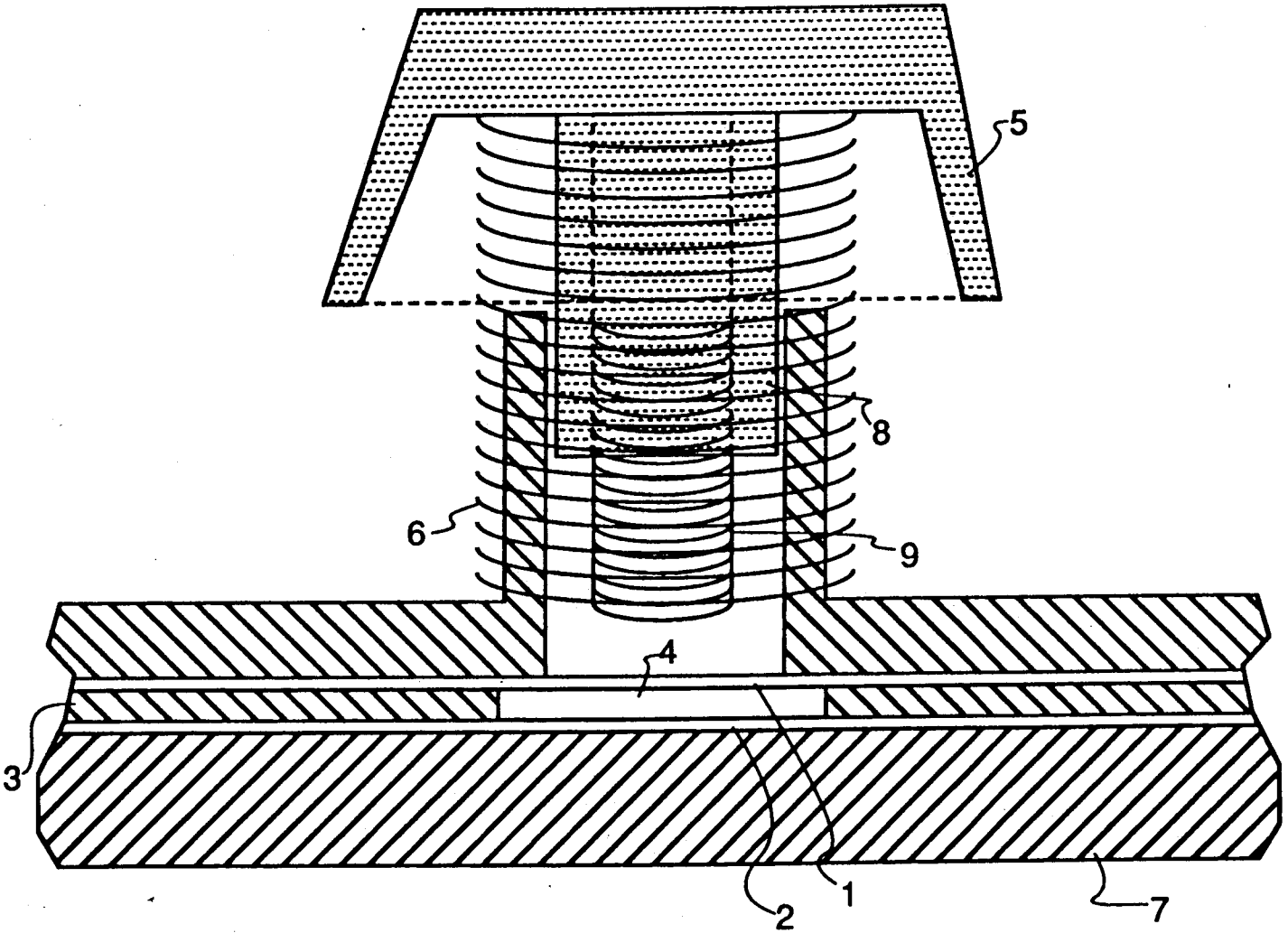
FIG. 1 (PRIOR ART)
FIG. 1 shows a typical prior art membrane key switch.
Figure 2:
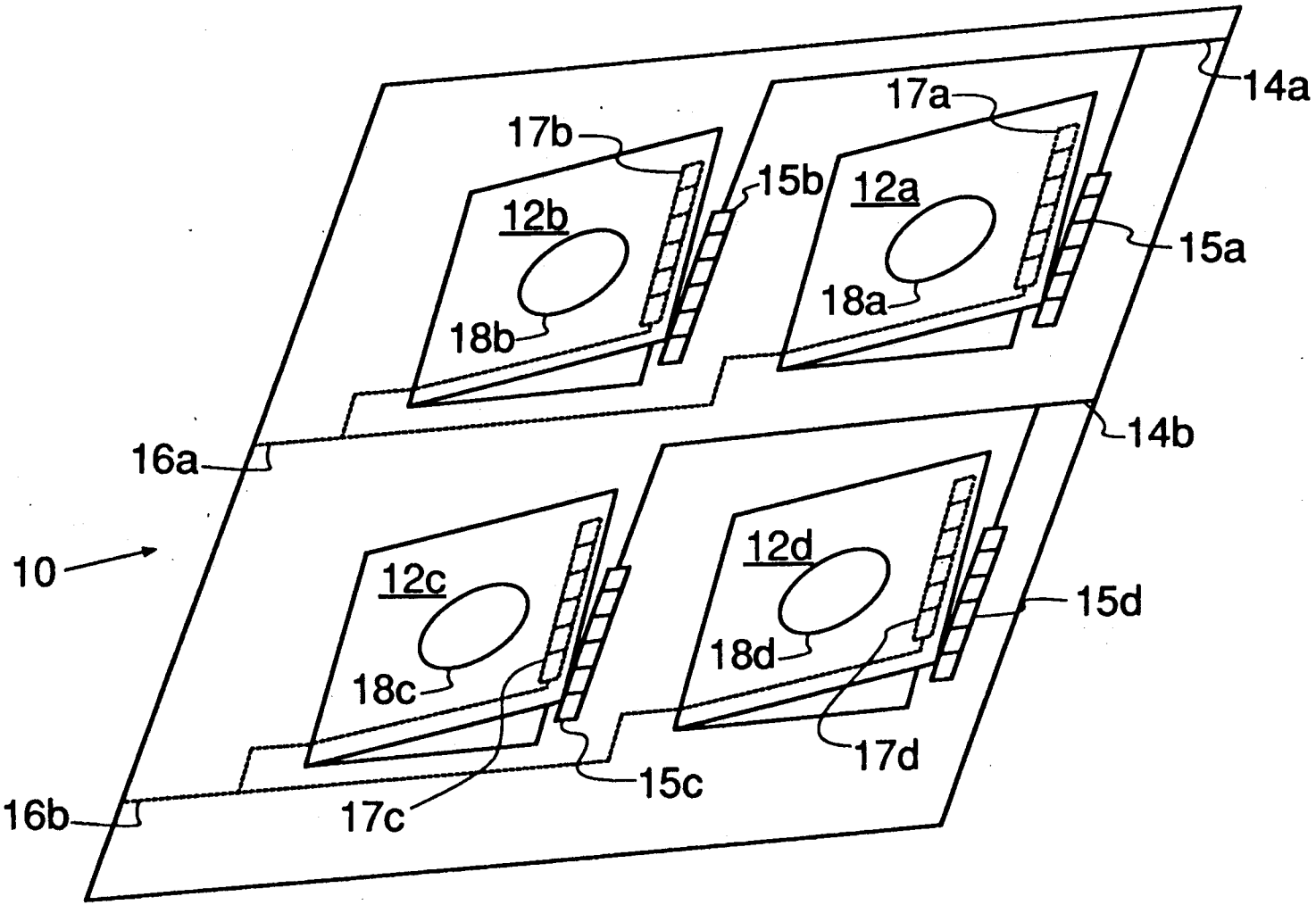
FIG. 2 shows one section of a membrane for a switch according to the first embodiment of this invention.

FIG. 2 shows a resiliently deformable dielectric sheet 10, such a Mylar® sheet, used to create a keyboard switching matrix according to the first embodiment of this invention Three-sided flaps 12a–12d are cut from the dielectric sheet 10. Conductive traces 14a and 14b, including contact regions 15a–15d along the edge of the flap cut-outs, are formed on the top surface of the dielectric sheet by any suitable means such as well-known silk screening techniques. Conductive traces 16a and 16b including contact regions 17a–17d are formed on the bottom side of dielectric sheet 10 and flaps 12a–12d. Contact regions 15a–15d and 17d–17d are shown extending across the flap cut-out edge and the flap edge but any suitable configuration may be used. Holes 18a–18d, the purpose of which is explained below, may optionally be formed in flaps 12a–12d.

Figure 3:
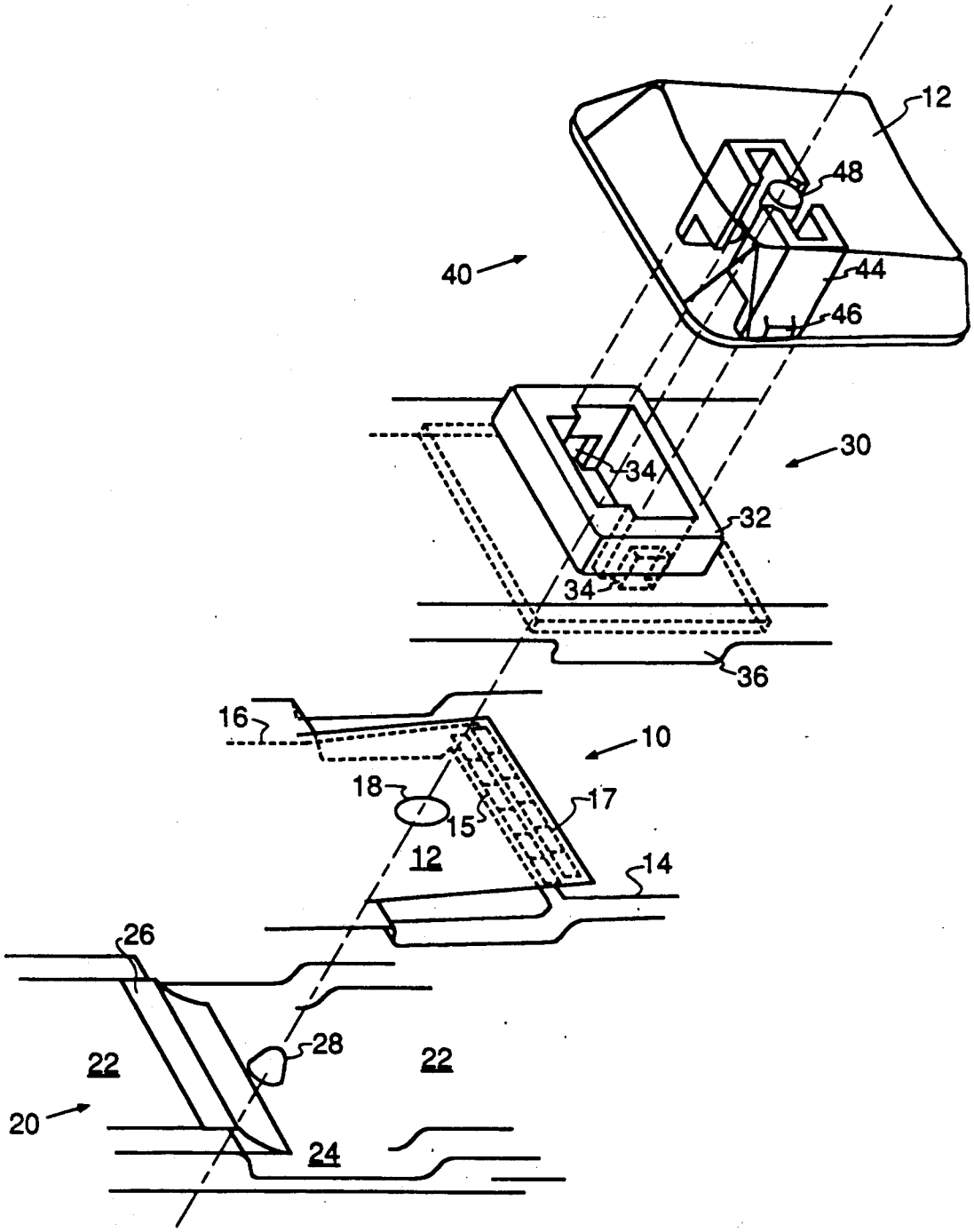
FIG. 3 shows an exploded view of the first embodiment of a membrane key switch according to this invention.

FIG. 3 shows an exploded view of the first embodiment of a membrane key switch according to this invention. Lower housing 20 comprises a flat surface 22, a depressed area 24 and an upward slope 26. Protrusion 28 can be fitted with a spring as described below. When dielectric sheet 10 properly conforms to lower housing 20, the area of the sheet between flap 12 will cover the depression 24 so that the end portion of each flap 12 overlaps a portion of sheet 10. Flap 12 will extend over upward slope 26 and thus be raised above surface 22 covered by dielectric sheet 10 so that the end portion of flap 12 will be separated from sheet 10. If desired, the upward bend of the flap 12 may be preformed. This arrangement of lower housing 20 and sheet 10 positions contact region 15 on top of sheet 10 directly below and facing contact region 17 on the bottom of flap 12. However, the contact regions are prevented from unintentionally establishing an electrical connection by upward slope 26.

Upper housing 30 comprises projecting holder 36 and outer guide 32 formed with indentations 34. When upper housing 30 is mounted on lower housing 20, projecting holder 36 engages depressed area 24, thereby firmly holding the area of dielectric sheet 10 between flaps 12 between the upper and lower housings. If desired, adhesive or other suitable means for holding sheet 10 to lower housing 20 may be used.

Key 40 comprises head 42, innerguide 44 with projections 46 and key stem 48 slidably mounted between the walls of innerguide 44. Projections 46 detachably engage indentations 34, which facilitates the assembly of the key 40 to the upper housing 30. Key stem 48 is attached to head 42 so that the depression of head 42 causes the downward movement of key stem 48.

Figure 4A:
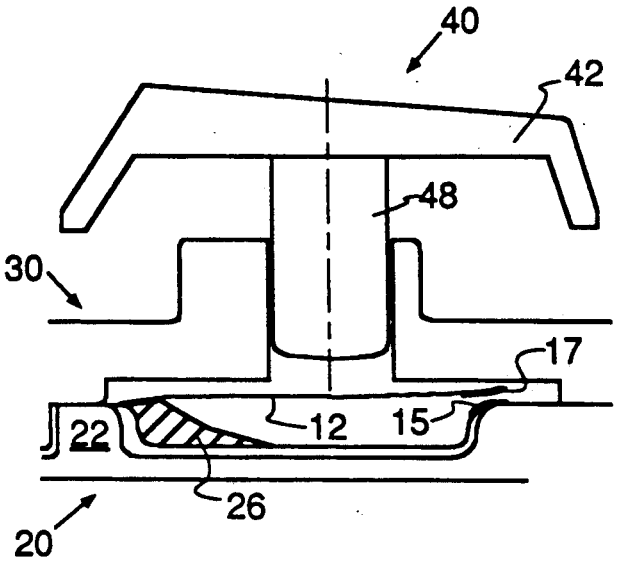
FIG. 4*a* shows a sectional view of the first embodiment of a membrane key switch in its undepressed position.

FIG. 4a shows the key 40 in its raised position. Key 40 may be maintained in its raised position by a coil or leaf spring (not shown) or any other suitable means. Contact regions 15 and 17 are positioned facing each other but are not touching so that no electrical connection is established.

Figure 4B:
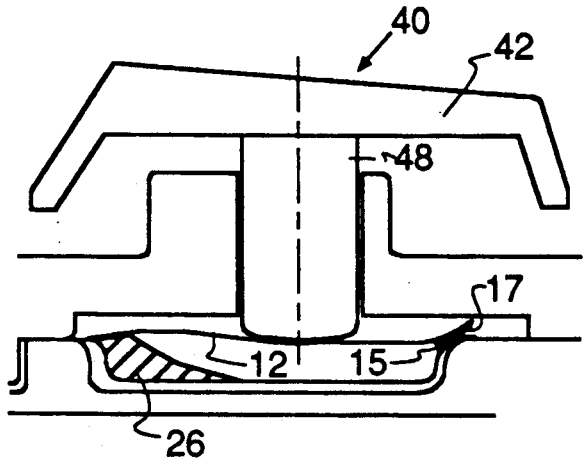
FIG. 4*b* shows a sectional view of the first embodiment of a membrane key switch at the switch makepoint.

FIG. 4b shows the membrane key switch at the switch makepoint. An electrical connection is established by the touching of contact regions 15 and 17. Although key stem 48 bears down on flap 12, key stem 48 has not yet impacted lower housing 20.

Figure 4C:
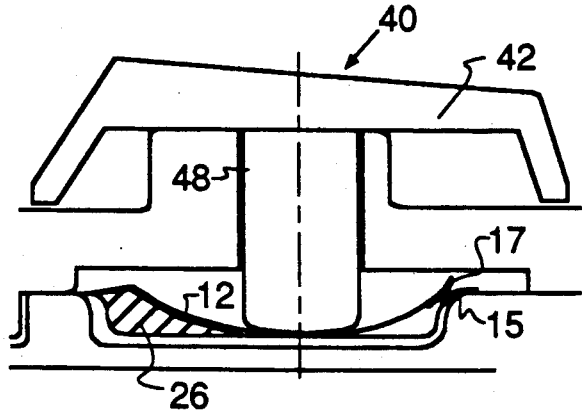
FIG. 4*c* shows a sectional view of the first embodiment of a membrane key switch in its fully depressed position.

FIG. 4c shows the key 40 in its fully depressed position. After the switch makepoint, the key stem 48 can continue to travel downward until it impacts lower housing 20, thereby allowing aftertravel without the addition of extra components such as springs. As key 40 is further depressed from the switch makepoint position, key stem 48 forces flap 12 further downward, causing the contact regions 15 and 17 to slide against each other. This sliding performs a cleaning action on the contact regions.

A coil spring (not shown) for maintaining key 40 in a raised position may engage key stem 48 and extend downward through hole 18 of flap 12. The spring can be held stationary by fitting over projection 28 of lower housing 20. By providing a change in resistance as the key is depressed, the spring also delivers a tactile signal to the operator.

Figure 5:
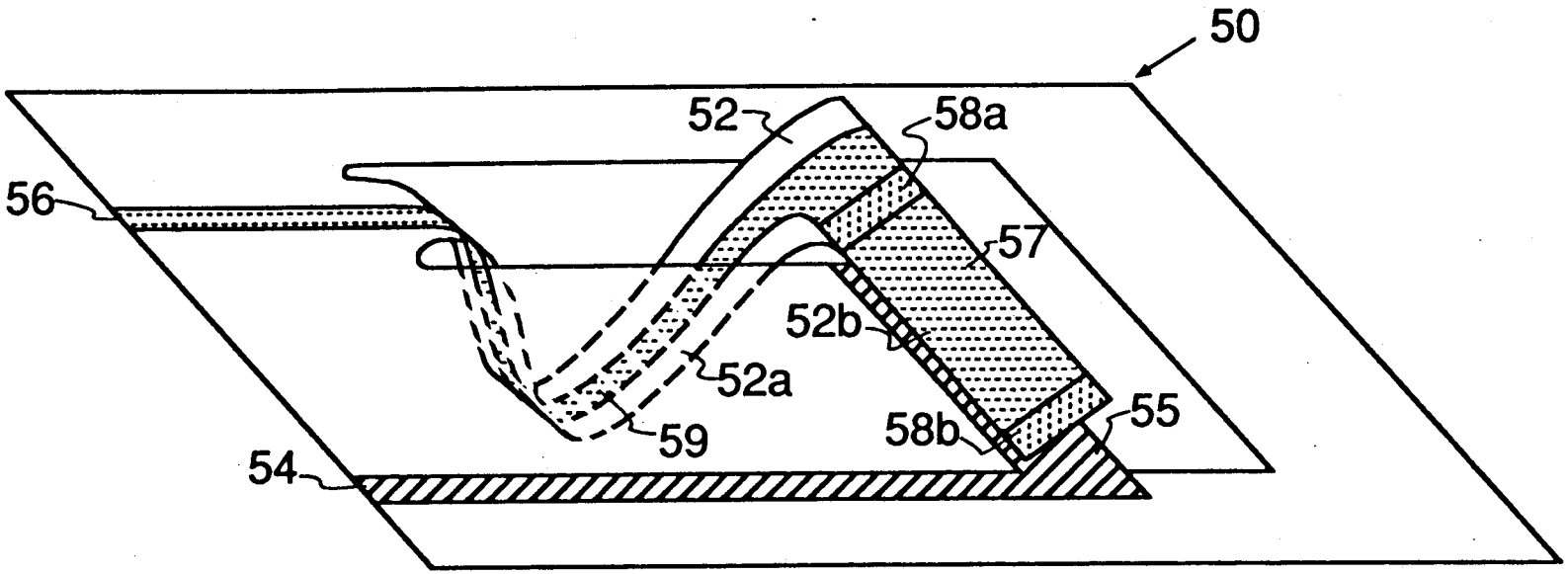
FIG. 5 shows one section of a membrane for a switch according to the second embodiment of this invention.

FIG. 5 shows a resiliently deformable dielectric sheet 50, such as a Mylar® sheet used to create a keyboard switching matrix according to a second embodiment of this invention. An L-shaped flap 52 having legs 52a and 52b is cut from the sheet 50. Conductive trace 54, including a contact region 55 along the edge of the flap cut-out, is formed on the top surface of the dielectric sheet by any suitable means such as well-known silk screening techniques. Conductive trace 56, including a contact region 57 along leg 52b, is formed on the bottom side of the dielectric sheet 50 and flap 52. Contact regions 57 and 55 are shown extending along leg 52b and the edge of the flap cut-out, but any suitable configuration may be used.

L-shaped flap 52 is deformed by the switch housing in the manner described below to form a bend 59 in leg 52a so that contact region 57 is positioned above contact region 55. Spacers 58a and 58b may be used to separate contact region 57 from contact region 55 when the switch is not actuated. Spacers 58a and 58b are thin portions of any suitable non-conductive material, typically 8–10 thousandths of inch thick, applied over the contact region 55 by any suitable means such as silk screening. Alternatively, flap 52 may be preformed such that it can maintain the separation of contact regions 55 and 57 without the aid of spacers.

Figure 6:
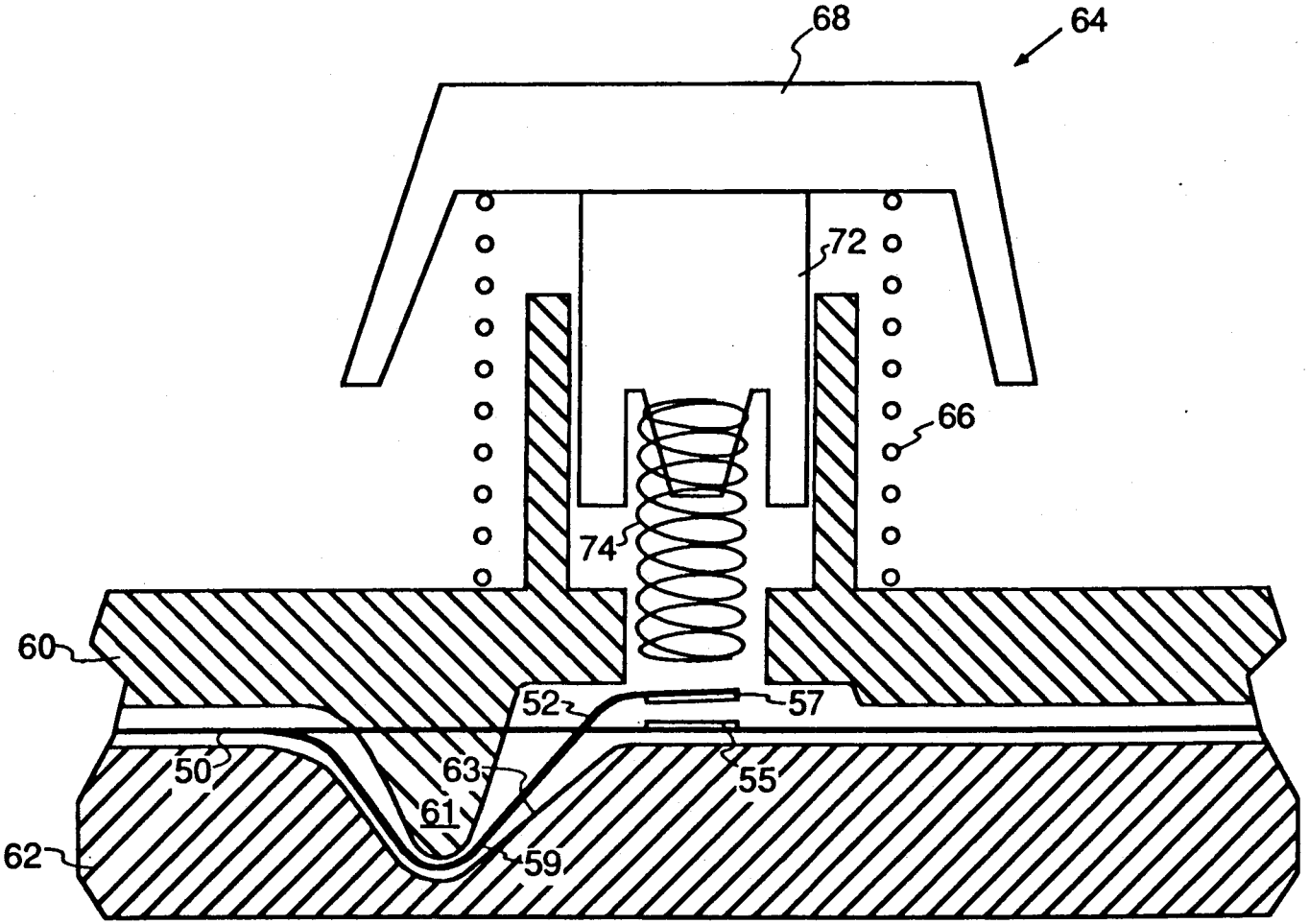
FIG. 6 shows a sectional view of the second embodiment of a membrane key switch in its undepressed position.

FIG. 6 shows a sectional view of a membrane key switch according to the second embodiment of this invention in its raised position. Membrane 50 is securely held between upper housing 60 and lower housing 62. Protrusion 61 of upper housing 60 forms bend 59 in leg 52a of L-shaped flap 52 by forcing the flap 52 into depression 63. Contact region 57 on the underside of flap 52 is positioned directly above contact region 55 on the top side of membrane 50 because flap 52 covers a longer path than the remainder of membrane 50.

Key 64 is maintained in its raised position by return spring 66. When key head 68 is depressed, key stem 72 slides downward and inner spring 74 which is attached to key stem 62 contacts leg 52b and forces it downward until it contacts membrane 50, thereby making an electrical connection between contact region 57 and contact region 55. After the electrical connection has been made, key 64 can continue to travel downward as the springs 66 and 74 are further compressed. Inner spring 74 causes an electrical connection to be made before the end of switch travel, the point at which either key stem 70 impacts lower housing 62 or springs 66 and 74 become fully compressed. Overtravel is therefore provided by inner spring 74.

Although only a single switch of a keyboard has been described in two embodiments, a plurality of either of the switches shown, mounted in the same manner, would be used to compose a keyboard.

The concepts of this invention may be modified while keeping within the spirit and scope of this invention, that being the use of a single dielectric sheet to form a switching matrix in a membrane key switch.

I claim:

1. An electrical switch comprising:

a single dielectric sheet, said dielectric sheet having a first portion with a first conductive trace formed thereon, and a second portion with a second conductive trace formed thereon, wherein said first portion of said dielectric sheet is included in a flap formed in said dielectric sheet;

said first and second conductive traces being formed on opposite sides of said dielectric sheet;

means for maintaining said flap in a position whereby said first portion is positioned above said second portion of said dielectric sheet;

said first and second portions being relatively movable such that said first conductive trace may contact said second conductive trace;

means for bringing said first conductive trace into contact with said second conductive trace.

2. An electrical switch comprising:

a dielectric sheet having a slap formed therein, said flap having a portion separated from and overlapping a portion of said dielectric sheet, said portions, respectively, being on opposite sides of said sheet;

a first conductive trace formed on said portion of said flap;

a second conductive trace formed on said portion of said dielectric sheet;

said portion of said flap and said portion of said dielectric sheet being relatively movable;

said first and second conductive traces positioned such that relative movement of said portion of said flap and said portion of said dielectric sheet may cause said first conductive trace to contact said second conductive trace;

means for maintaining said first and second conductive traces apart when said switch is in an open condition; and means for bringing said first and second conductive traces together to close said switch.

3. An electrical switch according to claim 2 further comprising:

a housing having a depression formed therein;

said sheet being deformed into said depression to create said overlapping between said portion of said flap and said portion of said sheet;

said means for bringing said first and second conductive traces together comprising a depressable key, said key slidably mounted in said housing; and said key positioned to force said portion of said flap downward upon depression of said key whereby said first conductive trace contacts said second conductive trace.

4. An electrical switch according to claim 3 further comprising means for allowing continued downward movement of said portion of said flap after said first conductive trace contacts said second conductive trace.

5. an electrical switch according to claim 3 wherein said means for maintaining said first and second conductive traces apart comprises an upward sloping region of said housing positioned to engage said flap such that said flap portion is separated from said dielectric sheet.

6. An electrical switch according to claim 2 wherein said flap is substantially L-shaped and further comprising:

a housing having a depression formed therein;

said flap being deformed into said depression to create said overlapping between said portion of said flap and said portion of said sheet;

said means for bringing said first and second conductive traces together comprising a depressable key, said key having a stem slidably mounted in said housing;

said key stem having a compressible spring mounted thereon and projecting downward therefrom, said spring positioned so as to engage said flap and to force said portion of said flap downward upon depression of said key, whereby said first conductive trace contacts said second conductive trace and whereby through the means of said compressible spring said key stem is allowed to continue to move downward after said contact between said first and second conductive traces.

7. An electrical switch comprising:

a dielectric sheet having an upper surface and a lower surface;

means for supporting said dielectric sheet;

a flap formed in said dielectric sheet, having a free end and an end which is attached to said sheet, and further having an upper surface corresponding to the upper surface of said sheet and a lower surface corresponding to the lower surface of said sheet, said flap capable of being moved to a deflected position relative to said sheet;

an opening in said dielectric sheet which is formed when said flap is moved to said deflected position;

a first conductive trace formed on the lower surface of said flap;

a second conductive trace formed on the upper surface of said dielectric sheet substantially adjacent said opening;

means for positioning said first conductive trace above said second conductive trace including means for maintaining the flap in a deflected position when said switch is in an open condition; and means for moving said first conductive trace into contact with said second conductive trace to close said switch.

8. An electrical switch as claimed in claim 7 wherein said supporting means comprises a housing and wherein said means for positioning said first conductive trace above said second conductive trace comprises a depressed area in the housing and means for depressing a portion of the sheet into said depressed area, said means for depressing said sheet not engaging said flap.

9. An electrical switch as claimed in claim 8 wherein said means for maintaining said flap in a deflected position comprises an element mounted on said housing which engages the lower surface of said flap so as to raise said flap to a deflected position.

10. An electrical switch as claimed in claim 8 wherein said depressed area has a border and said second conductive trace overlies a portion of the housing substantially adjacent the border of the depressed area.

11. An electrical switch as claimed in claim 10 wherein said depressed area comprises a channel having a plurality of sides and said second conductive trace overlies a portion of the housing substantially adjacent a first side of the channel.

12. An electrical switch as claimed in claim 10 comprising a key which includes a head, an innerguide, and a stem slidably disposed in the innerguide and capable of contacting the upper surface of said flap, whereby downward pressure on said head causes said first conductive trace to make electrical contact with said second conductive trace.

13. An electrical switch as claimed in claim 7 wherein said first conductive trace is substantially adjacent the free end of said flap.

14. An electrical switch as claimed in claim 7 wherein said flap is L-shaped.

15. An electrical switch as claimed in claim 14 wherein said supporting means comprises a housing and wherein said means for positioning said first conductive trace above said second conductive trace comprises a depression in said housing and means for depressing said flap into said depressed area, whereby said free end is raised to a position above the upper surface of said dielectric sheet.

* * * * *

UNITED STATES PATENT AND TRADEMARK OFFICE

CERTIFICATE OF CORRECTION

PATENT NO. : 5,032,695

DATED : July 16, 1991

INVENTOR(S) : Barry Mullins

It is certified that error appears in the above-identified patent and that said Letters Patent is hereby corrected as shown below:

Column 5, line 19 "slap" should read --flap--.

Signed and Sealed this

Ninth Day of February, 1993

*Attest:*

STEPHEN G. KUNIN

*Attesting Officer*

*Acting Commissioner of Patents and Trademarks*